US010487589B2

(12) United States Patent
Yu et al.

(10) Patent No.: US 10,487,589 B2
(45) Date of Patent: Nov. 26, 2019

(54) EARTH-BORING TOOLS, DEPTH-OF-CUT LIMITERS, AND METHODS OF FORMING OR SERVICING A WELLBORE

(71) Applicant: Baker Hughes, a GE company, LLC, Houston, TX (US)

(72) Inventors: Bo Yu, Spring, TX (US); Juan Miguel Bilen, The Woodlands, TX (US); John H. Stevens, The Woodlands, TX (US); Wanjun Cao, The Woodlands, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 696 days.

(21) Appl. No.: 15/002,230

(22) Filed: Jan. 20, 2016

(65) Prior Publication Data

US 2017/0204677 A1 Jul. 20, 2017

(51) Int. Cl.

| | |
|---|---|
| ***E21B 10/62*** | (2006.01) |
| ***E21B 10/42*** | (2006.01) |
| ***E21B 10/55*** | (2006.01) |

(52) U.S. Cl.

CPC ..... *E21B 10/62* (2013.01); *E21B 10/42* (2013.01); *E21B 10/55* (2013.01)

(58) Field of Classification Search

CPC ..... E21B 10/62; E21B 10/42; E21B 10/55

USPC ..... 175/57

See application file for complete search history.

(56) References Cited

U.S. PATENT DOCUMENTS

| | | | |
|---|---|---|---|
| 3,900,939 | A | 8/1975 | Greacen |
| 4,281,841 | A | 8/1981 | Kim et al. |
| 4,582,149 | A | 4/1986 | Slaughter, Jr. |
| 4,597,632 | A | 7/1986 | Mallinson |
| 4,619,320 | A | 10/1986 | Adnyana et al. |

(Continued)

FOREIGN PATENT DOCUMENTS

| | | | |
|---|---|---|---|
| JP | 10068284 | A | 3/1998 |
| WO | 2014055089 | A1 | 4/2014 |

(Continued)

OTHER PUBLICATIONS

International Search Report for International Application No. PCT/US2017/013746 dated Apr. 27, 2017, 4 pages.

(Continued)

*Primary Examiner* — Anna M Momper
*Assistant Examiner* — Patrick F Lambe
(74) *Attorney, Agent, or Firm* — TraskBritt

(57) ABSTRACT

An earth-boring tool includes a bit body and an actuator coupled to the bit body. The actuator includes at least one shape memory material configured to transform from a first shape to a second shape to move a bearing pad or a cutting element with respect to the bit body in response to a stimulus. A transformation from the first shape to the second shape includes a phase change from a first solid phase to a second solid phase. A depth-of-cut limiter includes a bearing element and at least one shape memory material coupled to the bearing element. A method of forming or servicing a wellbore includes rotating an earth-boring tool within a wellbore, applying a stimulus to an actuator to convert at least one shape memory material from a first shape to a second shape, and continuing to rotate the earth-boring tool within the wellbore after applying the stimulus.

18 Claims, 7 Drawing Sheets

(56) References Cited

U.S. PATENT DOCUMENTS 4,637,436 A 1/1987 Stewart et al.
4,700,790 A 10/1987 Shirley
4,743,079 A 5/1988 Bloch
4,754,538 A 7/1988 Stewart et al.
4,776,412 A 10/1988 Thompson
4,794,995 A 1/1989 Matson et al.
4,840,346 A 6/1989 Adnyana et al.
5,040,283 A 8/1991 Pelgrom
5,199,497 A 4/1993 Ross
5,380,068 A 1/1995 Raghavan
5,395,193 A 3/1995 Krumme et al.
5,494,124 A 2/1996 Dove et al.
5,507,826 A 4/1996 Besselink et al.
5,536,126 A 7/1996 Gross
5,632,349 A 5/1997 Dove et al.
5,653,298 A 8/1997 Dove et al.
5,662,362 A 9/1997 Kapgan et al.
5,678,645 A 10/1997 Tibbitts et al.
5,718,531 A 2/1998 Mutschler, Jr. et al.
5,722,709 A 3/1998 Lortz et al.
5,858,020 A 1/1999 Johnson et al.
5,906,245 A 5/1999 Tibbitts et al.
6,062,315 A 5/2000 Reinhardt
6,209,664 B1 4/2001 Amaudric Du Chaffaut
6,311,793 B1 11/2001 Larsen et al.
6,321,845 B1 11/2001 Deaton
6,388,043 B1 5/2002 Langer et al.
6,433,991 B1 8/2002 Deaton et al.
6,484,822 B2 11/2002 Watson et al.
6,484,825 B2 11/2002 Watson et al.
6,732,817 B2 5/2004 Dewey et al.
6,742,585 B1 6/2004 Braithwaite et al.
6,749,376 B2 6/2004 Keefe et al.
6,779,602 B1 8/2004 Van Bilderbeek et al.
6,786,557 B2 9/2004 Montgomery, Jr.
6,880,650 B2 4/2005 Hoffmaster et al.
6,971,459 B2 12/2005 Raney
7,201,237 B2 4/2007 Raney
7,270,188 B2 9/2007 Cook et al.
7,275,601 B2 10/2007 Cook et al.
7,299,881 B2 11/2007 Cook et al.
7,314,099 B2 1/2008 Dewey et al.
7,357,190 B2 4/2008 Cook et al.
7,392,857 B1 7/2008 Hall et al.
7,419,016 B2 9/2008 Hall et al.
7,424,922 B2 9/2008 Hall et al.
7,451,836 B2 11/2008 Hoffmaster et al.
7,451,837 B2 11/2008 Hoffmaster et al.
7,493,971 B2 2/2009 Nevlud et al.
7,533,737 B2 5/2009 Hall et al.
7,571,780 B2 8/2009 Hall et al.
7,594,552 B2 9/2009 Radford et al.
7,641,002 B2 1/2010 Hall et al.
7,661,490 B2 2/2010 Raney
7,721,823 B2 5/2010 Radford
7,730,975 B2 6/2010 Hall et al.
7,845,430 B2 12/2010 Johnson et al.
7,849,939 B2 12/2010 Downton et al.
7,882,905 B2 2/2011 Radford et al.
7,954,568 B2 6/2011 Bilen
7,971,661 B2 7/2011 Johnson et al.
7,971,662 B2 7/2011 Beuershausen
8,011,456 B2 9/2011 Sherwood, Jr.
8,087,479 B2 1/2012 Kulkarni et al.
8,141,665 B2 3/2012 Ganz
8,201,648 B2 6/2012 Choe et al.
8,205,686 B2 6/2012 Beuershausen
8,205,689 B2 6/2012 Radford
8,225,478 B2 7/2012 Kane
8,240,399 B2 8/2012 Kulkarni et al.
8,281,882 B2 10/2012 Hall et al.
8,302,703 B2 11/2012 Rolovic
8,376,065 B2 2/2013 Teodorescu et al.
8,381,844 B2 2/2013 Matthews, III et al.
8,388,292 B2 3/2013 Kirkwood et al.
8,453,763 B2 6/2013 Radford et al.
8,496,076 B2 7/2013 DiGiovanni et al.
8,511,946 B2 8/2013 Woodruff et al.
8,534,384 B2 9/2013 Beuershausen et al.
8,579,052 B2 11/2013 DiGiovanni et al.
8,727,042 B2 5/2014 DiGiovanni
8,727,043 B2 5/2014 Zhang et al.
8,746,368 B2 6/2014 Johnson et al.
8,763,726 B2 7/2014 Johnson et al.
8,813,871 B2 8/2014 Radford et al.
8,950,517 B2 2/2015 Hall et al.
8,960,329 B2 2/2015 Downton
8,997,897 B2 4/2015 De Reynal
9,080,399 B2 7/2015 Oesterberg
9,091,132 B1 7/2015 Cooley et al.
9,103,175 B2 8/2015 Schwefe
9,140,074 B2 9/2015 Schwefe et al.
9,180,525 B2 11/2015 Park et al.
9,181,756 B2 11/2015 Schwefe et al.
9,187,960 B2 11/2015 Radford et al.
9,255,449 B2 2/2016 Schwefe et al.
9,255,450 B2 2/2016 Jain et al.
9,267,329 B2 2/2016 Bilen
9,279,293 B2 3/2016 Izbinski
9,359,826 B2 6/2016 Do et al.
9,399,892 B2 7/2016 Do et al.
9,422,964 B2 8/2016 Rule et al.
9,611,697 B2 4/2017 Radford et al.
9,663,995 B2 5/2017 Jain
9,677,344 B2 6/2017 Radford et al.
9,708,859 B2 7/2017 Jain et al.
9,759,014 B2 9/2017 Do et al.
9,915,138 B2 3/2018 Schwefe et al.
9,932,780 B2 4/2018 Spencer et al.
9,970,239 B2 5/2018 Oesterberg
10,000,977 B2 6/2018 Jain et al.
10,001,005 B2 6/2018 Schwefe et al.
10,041,305 B2 8/2018 Jain
2002/0062547 A1 5/2002 Chiodo et al.
2004/0069540 A1 4/2004 Kriesels et al.
2004/0155125 A1 8/2004 Kramer et al.
2004/0194970 A1 10/2004 Eatwell et al.
2006/0019510 A1 1/2006 Rudduck et al.
2006/0048936 A1 3/2006 Fripp et al.
2006/0266557 A1 11/2006 Estes
2007/0227775 A1 10/2007 Ma et al.
2008/0236899 A1 10/2008 Oxford et al.
2009/0133931 A1 5/2009 Rolovic
2009/0139727 A1 6/2009 Tanju et al.
2009/0205833 A1 8/2009 Bunnell et al.
2009/0321145 A1 12/2009 Fisher et al.
2010/0038141 A1 2/2010 Johnson et al.
2010/0071956 A1 3/2010 Beuershausen
2010/0132957 A1 6/2010 Joseph et al.
2010/0187018 A1* 7/2010 Choe ..... B22D 19/14 175/426
2010/0314176 A1 12/2010 Zhang et al.
2011/0031025 A1 2/2011 Kulkarni et al.
2011/0146265 A1 6/2011 Joseph et al.
2011/0155473 A1 6/2011 Raney
2012/0255784 A1* 10/2012 Hanford ..... E21B 10/54 175/57
2012/0312599 A1 12/2012 Trinh et al.
2013/0180784 A1 7/2013 Esko et al.
2014/0216827 A1 8/2014 Zhang et al.
2014/0374167 A1 12/2014 Mueller et al.
2015/0152723 A1* 6/2015 Hay ..... E21B 47/01 175/17
2015/0218889 A1 8/2015 Carroll et al.
2016/0138353 A1 5/2016 Ruttley et al.
2016/0258224 A1 9/2016 Do et al.
2017/0175455 A1 6/2017 Jain et al.
2017/0234071 A1 8/2017 Spatz et al.
2017/0335631 A1 11/2017 Eddison
2017/0362898 A1 12/2017 Do et al.
2018/0128060 A1 5/2018 Haugvaldstad
2018/0179826 A9 6/2018 Jain et al.

(56) References Cited

U.S. PATENT DOCUMENTS

FOREIGN PATENT DOCUMENTS

| | | | |
|---|---|---|---|
| WO | 2015088508 | A1 | 6/2015 |
| WO | 2015195244 | A1 | 12/2015 |
| WO | 2016057076 | A1 | 4/2016 |
| WO | 2016/187372 | A1 | 11/2016 |
| WO | 2017/044763 | A1 | 3/2017 |
| WO | 2017/106605 | A1 | 6/2017 |
| WO | 2017/132033 | A1 | 8/2017 |
| WO | 2017/142815 | A1 | 8/2017 |

OTHER PUBLICATIONS

International Written Opinion for International Application No. PCT/US2017/013746 dated Apr. 27, 2017, 6 pages.

* cited by examiner

EARTH-BORING TOOLS, DEPTH-OF-CUT LIMITERS, AND METHODS OF FORMING OR SERVICING A WELLBORE

CROSS-REFERENCE TO RELATED APPLICATIONS

The subject matter of this application is related to the subject matter of U.S. patent application Ser. No. 15/002,211, filed Jan. 20, 2016, for "Earth-Boring Tools and Methods for Forming Earth-Boring Tools Using Shape Memory Materials," and U.S. patent application Ser. No. 15/002,189, filed Jan. 20, 2016, for "Nozzle Assemblies Including Shape Memory Materials for Earth-Boring Tools and Related Methods," the disclosure of each of which is hereby incorporated herein by this reference.

FIELD

Embodiments of the present disclosure relate generally to cutting elements, inserts, polycrystalline compacts, drill bits, and other earth-boring tools, and to methods of securing cutting elements, inserts, and polycrystalline compacts to bit bodies.

BACKGROUND

Earth-boring tools are used to form boreholes (e.g., wellbores) in subterranean formations. Such earth-boring tools include, for example, drill bits, reamers, mills, etc. For example, a fixed-cutter earth-boring rotary drill bit (often referred to as a "drag" bit) generally includes a plurality of cutting elements secured to a face of a bit body of the drill bit. The cutters are fixed in place when used to cut formation materials. A conventional fixed-cutter earth-boring rotary drill bit includes a bit body having generally radially projecting and longitudinally extending blades. During drilling operations, the drill bit is positioned at the bottom of a well borehole and rotated.

Cutting elements are typically positioned on each of the blades. The cutting elements commonly include a "table" of superabrasive material, such as mutually bound particles of polycrystalline diamond, formed on a supporting substrate of a hard material, such as cemented tungsten carbide. Such cutting elements are often referred to as "polycrystalline diamond compact" (PDC) cutting elements or cutters. The PDC cutting elements may be fixed within cutting element pockets formed in rotationally leading surfaces of each of the blades. Conventionally, a bonding material, such as a braze alloy, may be used to secure the cutting elements to the bit body.

Some earth-boring tools may also include backup cutting elements, bearing elements, or both. Backup cutting elements are conventionally fixed to blades rotationally following leading cutting elements. The backup cutting elements may be located entirely behind associated leading cutting elements or may be laterally exposed beyond a side of a leading cutting element, longitudinally exposed above a leading cutting element, or both. As the leading cutting elements are worn away, the backup cutting elements may be exposed to a greater extent and engage with (e.g., remove by shearing cutting action) an earth formation. Similarly, some bearing elements have been fixed to blades rotationally following leading cutting elements. The bearing elements conventionally are located entirely behind associated leading cutting elements to limit depth-of-cut (DOC) as the bearing elements contact and ride on an underlying earth formation.

BRIEF SUMMARY

In some embodiments, an earth-boring tool includes a bit body and an actuator coupled to the bit body. The actuator includes at least one shape memory material configured to transform from a first shape to a second shape to change a position of at least one of a bearing pad or a cutting element coupled to the actuator with respect to the bit body in response to a stimulus. A transformation from the first shape to the second shape includes a phase change in the at least one shape memory material from a first solid phase to a second solid phase.

A depth-of-cut limiter for an earth-boring tool includes a bearing element and at least one shape memory material mechanically coupled to the bearing element. The bearing element is configured to contact an exposed surface of a subterranean formation when the depth-of-cut limiter is used in an earth-boring tool to form or service a wellbore. The at least one shape memory material is configured to transform from a first shape to a second shape in response to a stimulus. A transformation from the first shape to the second shape includes a phase change in the at least one shape memory material from a first solid phase to a second solid phase.

A method of forming or servicing a wellbore includes rotating an earth-boring tool within a wellbore. The earth-boring tool includes a bit body and an actuator coupled to the bit body. The actuator includes at least one shape memory material configured to transform from a first shape to a second shape to change a position of at least one of a bearing pad or a cutting element with respect to the bit body in response to a stimulus. A transformation from the first shape to the second shape includes a phase change in the at least one shape memory material from a first solid phase to a second solid phase. The method further includes applying a stimulus to the actuator to convert the at least one shape memory material from the first shape to the second shape, and continuing to rotate the earth-boring tool within the wellbore after applying the stimulus.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

The illustrations presented herein are not actual views of any particular cutting element, insert, or drill bit, but are merely idealized representations employed to describe example embodiments of the present disclosure. Additionally, elements common between figures may retain the same numerical designation.

As used herein, the term "polycrystalline hard material" means and includes any material comprising a plurality of grains or crystals of the material bonded directly together by inter-granular bonds. The crystal structures of the individual grains of polycrystalline hard material may be randomly oriented in space within the polycrystalline hard material.

As used herein, the term "polycrystalline compact" means and includes any structure comprising a polycrystalline hard material comprising inter-granular bonds formed by a process that involves application of pressure (e.g., compaction) to the precursor material or materials used to form the polycrystalline hard material.

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

Figure 1:
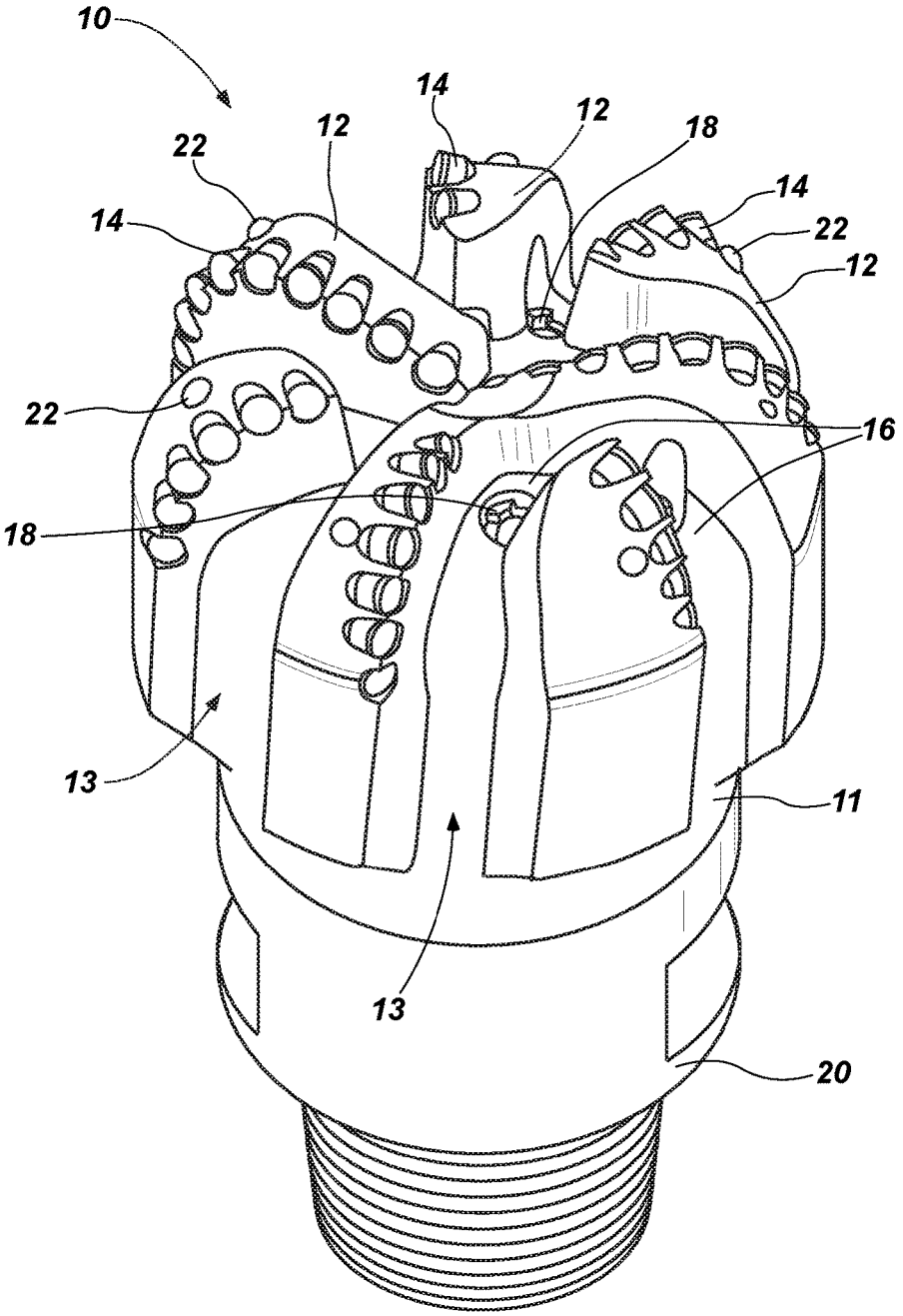
FIG. 1 is a perspective view of an embodiment of a downhole tool that includes a shape memory material using features and methods described herein.

FIG. 1 illustrates an embodiment of a downhole tool. The downhole tool of FIG. 1 is an earth-boring rotary drill bit 10 having a bit body 11 that includes a plurality of blades 12 separated from one another by fluid courses 13. The drill bit 10 is a fixed-cutter earth-boring rotary drill bit 10, but the features and principles disclosed herein may be used in other types of earth-boring tools, such as roller cone bits, percussion bits, hybrid bits, reamers, etc. The portions of the fluid courses 13 that extend along the radial sides (the "gage" areas of the drill bit 10) are often referred to in the art as "junk slots." A plurality of cutting elements 14 are mounted to the blades 12.

The cutting elements 14 may include a polycrystalline hard material. Typically, the polycrystalline hard material may be or include polycrystalline diamond, but may include other hard materials instead of or in addition to polycrystalline diamond. For example, the polycrystalline hard material may include cubic boron nitride. Optionally, cutting elements 14 may also include substrates to which the polycrystalline hard material is bonded, or on which the polycrystalline hard material is formed in an HPHT process. For example, the substrate may include a generally cylindrical body of cobalt-cemented tungsten carbide material, although substrates of different geometries and compositions may also be employed. The polycrystalline hard material may be in the form of a table (i.e., a layer) of polycrystalline hard material on the substrate, as known in the art and not described in detail herein. The polycrystalline hard material may be provided on (e.g., formed on or secured to) a surface of the substrate. In additional embodiments, the cutting elements 14 may simply be volumes of the polycrystalline hard material having any desirable shape, and may not include any substrate. The cutting elements 14 may be referred to as "polycrystalline compacts," or, if the polycrystalline hard material includes diamond, as "polycrystalline diamond compacts."

The polycrystalline hard material may include interspersed and interbonded grains forming a three-dimensional network of hard material. Optionally, in some embodiments, the grains of the polycrystalline hard material may have a multimodal (e.g., bi-modal, tri-modal, etc.) grain size distribution. For example, the polycrystalline hard material may exhibit a multi-modal grain size distribution as disclosed in at least one of U.S. Pat. No. 8,579,052, issued Nov. 12, 2013, and titled "Polycrystalline Compacts Including In-Situ Nucleated Grains, Earth-Boring Tools Including Such Compacts, and Methods of Forming Such Compacts and Tools;" U.S. Pat. No. 8,727,042, issued May 20, 2014, and titled "Polycrystalline Compacts Having Material Disposed in Interstitial Spaces Therein, and Cutting Elements Including Such Compacts;" and U.S. Pat. No. 8,496,076, issued Jul. 30, 2013, and titled "Polycrystalline Compacts Including Nanoparticulate Inclusions, Cutting Elements and Earth-Boring Tools Including Such Compacts, and Methods of Forming Such Compacts;" the disclosures of each of which are incorporated herein in their entireties by this reference.

The bit body 11 further includes a generally cylindrical internal fluid plenum and fluid passageways that extend through the bit body 11 to an exterior surface 16 of the bit body 11. Nozzles 18 may be secured within the fluid passageways proximate the exterior surface 16 of the bit body 11 for controlling the hydraulics of the drill bit 10 during drilling.

The cutting elements 14 may be bonded, such as by brazing, into pockets in blades 12 of the bit body 11, as is known in the art with respect to the fabrication of so-called impregnated matrix, or, more simply, "matrix," type bits. The bit body 11 may include a mass of particulate material (e.g., a metal powder, such as tungsten carbide) infiltrated with a molten, subsequently hardenable binder (e.g., a copper-based alloy). In some embodiments, the bit body 11 may be a steel bit body or other type of bit body. The end of the drill bit 10 may include a shank 20 secured to the bit body 11. The shank 20 may be threaded with an API pin connection, as known in the art, to facilitate the attachment of drill bit 10 to a drill string.

Internal fluid passages of the drill bit 10 lead from the shank 20 to the nozzles 18. The nozzles 18 typically provide drilling fluid to the fluid courses 13, which lie between the blades 12, during drilling operations. Formation cuttings may be swept away from cutting elements 14 by drilling fluid expelled by nozzles 18, which moves generally radially outward through fluid courses 13 to an annulus between the drill string from which drill bit 10 is suspended, and up to the surface of the earth, out of the well.

One or more blades 12 may include a bearing element 22 to control the exposure of the cutting elements 14 to material of the subterranean formation during a drilling operation. By way of nonlimiting example, bearing elements 22 may be at least partially located on portions of blades 12 within the cone region of the drill bit 10. Bearing element 22, which may be of any size, shape, and/or thickness that suits the needs of a particular application, may lie substantially along the same radius from the axis of rotation of the drill bit 10 as one or more other bearing elements 22. The bearing elements 22 or surfaces thereof may provide sufficient surface area to withstand the axial or longitudinal WOB (weight-on-bit) without exceeding the compressive strength of the formation being drilled, so that the rock does not unduly indent or fail and so that the penetration depth of the cutting elements 14 into the rock is substantially controlled.

Bearing elements are described in further detail in U.S. Pat. No. 8,141,665, issued Mar. 27, 2012, and titled "Drill Bits with Bearing Elements for Reducing Exposure of Cutters," the entire disclosure of which is hereby incorporated herein by this reference.

Figure 2A:
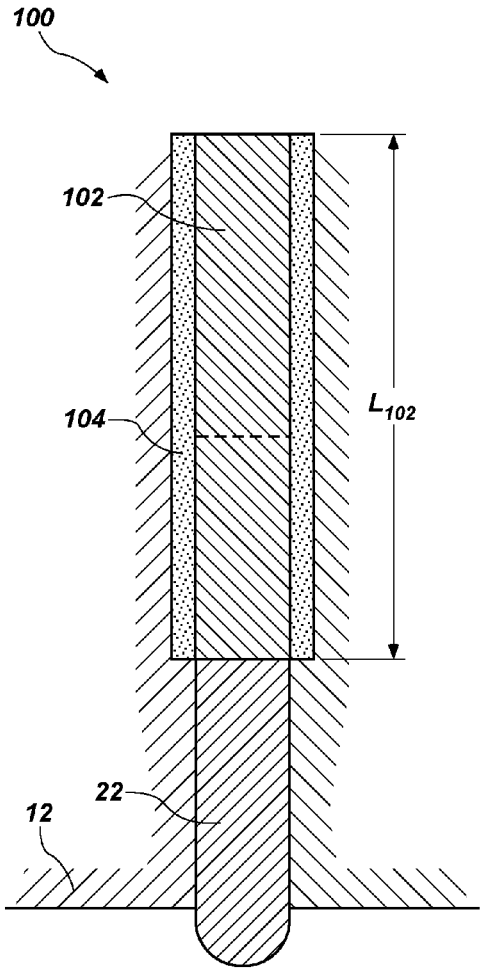
FIG. 2A is a simplified cross-sectional view of an actuator having a shape memory material.

FIG. 2A is a simplified cross-sectional view of a depth-of-cut limiter 100 configured to adjust the position of a bearing element 22 with respect to a bit body 11. The depth-of-cut limiter 100 may be at least partially disposed within a blade 12 of the bit body 11 (FIG. 1). The depth-of-cut limiter 100 may include an actuator 102 mechanically coupled to the bearing element 22. The bearing element 22 may be configured to contact an exposed surface of a subterranean formation when the depth-of-cut limiter 100 is used in an earth-boring tool to form or service a wellbore. The bearing element 22 may contact the subterranean formation without substantially cutting or removing the formation material. That is, the bearing element 22 may primarily slide over or along the surface of the formation. The bearing element 22 may have an ovoid surface, a spherical surface, a generally planar surface, or a surface having any other suitable selected shape. A generally rounded surface (e.g., ovoid, spherical, chamfered, etc.) may tend to slide over the subterranean formation without removing significant material from the formation. The cutting elements 14 (FIG. 1) may engage and remove the formation material, and the degree to which the cutting elements 14 engage may be controlled by the position of the bearing element 22, which may in turn be controlled by the actuator 102.

The actuator 102 may include a material configured to move the bearing element 22 longitudinally such that the bearing element 22 may extend different distances from the surface of the blade 12 to which the depth-of-cut limiter 100 is mounted, depending on the state of the actuator 102. In some embodiments, the actuator 102 may include one or more shape memory material(s). The bearing element 22 may be in the form of a generally cylindrical rod, and the actuator 102 may at least partially retain the bearing element 22. In some embodiments, the actuator 102 may be connected to another member configured to retain the bearing element 22.

Figure 2B:
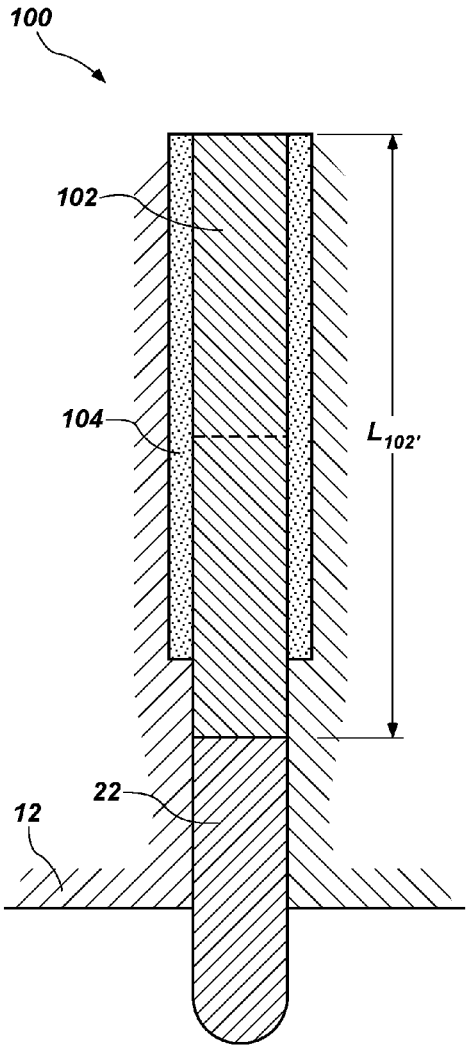
FIG. 2B is a simplified cross-sectional view of the actuator shown in FIG. 2A wherein the shape memory material is in another phase.

The actuator 102 may be configured to transform from a first shape to a second shape in response to a stimulus. For example, FIG. 2B shows the depth-of-cut limiter 100 after a change in which the length of the actuator 102 has increased from the state shown in FIG. 2A. The actuator 102 may have a length $L_{102}$ in FIG. 2A, and a length $L_{102}'$ in FIG. 2B. Though the actuator 102 is pictured as having a variable length, any other shape or dimension of the actuator 102 may change instead of or in addition to its length.

The transformation of the actuator 102 from the first shape (FIG. 2A) to the second shape (FIG. 2B) may include a phase change in the shape memory material from a first solid phase to a second solid phase. For example, such a transformation may occur above a preselected temperature, and a reverse transformation may occur below another preselected temperature. In some embodiments, the actuator 102 be configured to transform from the first shape to the second shape or vice versa when subjected to an electrical stimulus (e.g., Joule heating).

In some embodiments, the depth-of-cut limiter 100 may include a temperature modification element 104 to heat and/or cool the actuator 102 to promote a transformation from the first phase to the second phase. For example, the temperature modification element 104 may include a resistive heater, a heat exchanger, a thermoelectric device, or any other device. In some embodiments, the temperature modification element 104 may be configured as a jacket or sleeve substantially surrounding the actuator 102.

The actuator 102 may include one or more of any suitable shape memory material, such as a shape memory alloy or a shape memory polymer. As indicated by the dashed line in FIGS. 2A and 2B, the actuator 102 may include two or more shape memory materials stacked end-to-end. The shape memory materials may have different compositions, and may convert from one phase to another at different temperatures. Thus, the actuator 102 may have three or more different lengths, depending on which portions of the actuator 102 have been stimulated to change phase. In embodiments in which the actuator 102 includes two or more shape memory materials, the temperature modification element 104 may be configured to adjust the temperature of one, some fraction, or all of the shape memory materials. In some embodiments, one or more of the shape memory materials may change phase based on the temperature of the bit body in which the shape memory material is disposed. Furthermore, shape memory materials may undergo a continuous phase change over a temperature range. Thus, an actuator 102 may potentially have a continuous range of shapes or a series of discrete shapes. The ability to control the stimulus (e.g., the temperature) of the actuator may dictate the ability to maintain the actuator 102 in any particular phase and shape.

Shape memory alloys may include Ni-based alloys, Cu-based alloys, Co-based alloys, Fe-based alloys, Ti-based alloy, Al-based alloys, or any mixture thereof. For example, a shape memory alloy may include a 50:50 mixture by weight of nickel and titanium, a 55:45 mixture by weight of nickel and titanium, or a 60:40 mixture by weight of nickel and titanium. Many other compositions are possible and can be selected based on tool requirements and material properties as known in the art. Shape memory polymers may include, for example, epoxy polymers, thermoset polymers, thermoplastic polymers, or combinations or mixtures thereof. Shape memory materials are polymorphic and may exhibit two or more crystal structures or other solid phases. Shape memory materials may further exhibit a shape memory effect associated with the phase transition between two crystal structures or solid phases, such as austenite and martensite. The austenitic phase exists at elevated temperatures, while the martensitic phase exists at low temperatures. The shape memory effect may be triggered by a stimulus, which may be thermal, electrical, magnetic, or chemical, and which causes a transition from one phase to another.

Figure 3A:
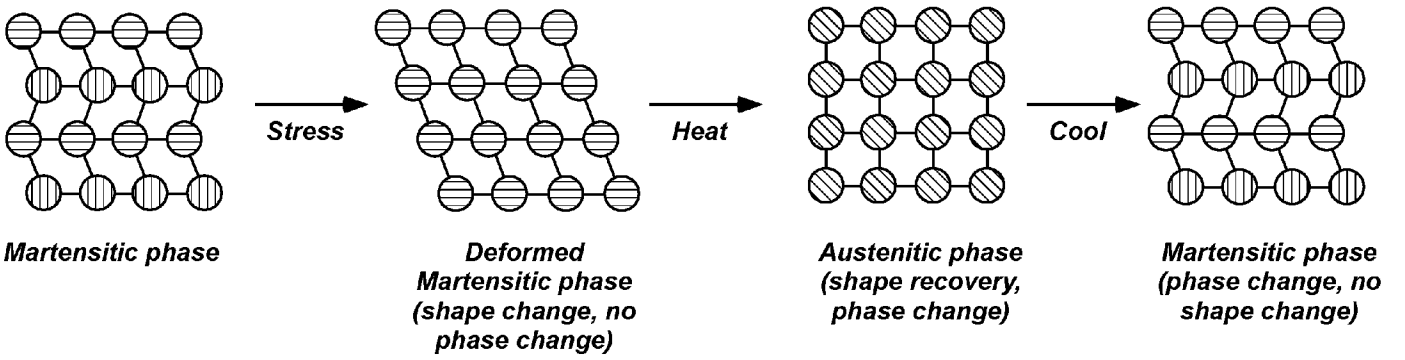
FIGS. 3A and 3B are simplified diagrams illustrating how the microstructure of a shape memory material may change in response to a stimulus.

By way of non-limiting example, a shape memory alloy may transform from an original austenitic phase (i.e., a high-temperature phase) to a martensitic phase (i.e., a low-temperature phase) upon cooling. The phase transformation from austenite to martensite may be spontaneous, diffusionless, and temperature-dependent. The transition temperatures from austenite to martensite and vice versa vary for different shape memory alloy compositions. The phase transformation from austenite to martensite occurs between a first temperature ($M_s$), at which austenite begins to transform to martensite and a second, lower temperature ($M_f$), at which only martensite exists. With reference to FIG. 3A, initially, the crystal structure of martensite is heavily twinned and may be deformed by an applied stress such that a material including martensite takes on a new size and/or shape. After the applied stress is removed, the material retains the deformed size and/or shape. However, upon heating, martensite may transform and revert to austenite.

The phase transformation occurs between a first temperature ($A_s$) at which martensite begins to transform to austenite and a second, higher temperature ($A_f$) at which only austenite exists. Upon a complete transition to austenite, the material returns to its original "remembered" size and/or shape. As used herein, the term "remembered" refers to a state to which a material returns. Upon a second cooling process and transformation from austenite to martensite, the crystal structure of the martensitic phase is heavily twinned and may be deformed by an applied stress such that the material takes on at least one of a new size and/or shape. The size and/or shape of the material in the previously deformed martensitic phase are not remembered from the initial cooling process. This shape memory effect may be referred to as a one-way shape memory effect, such that the material exhibits the shape memory effect only upon heating as illustrated in FIG. 3A.

Figure 3B:
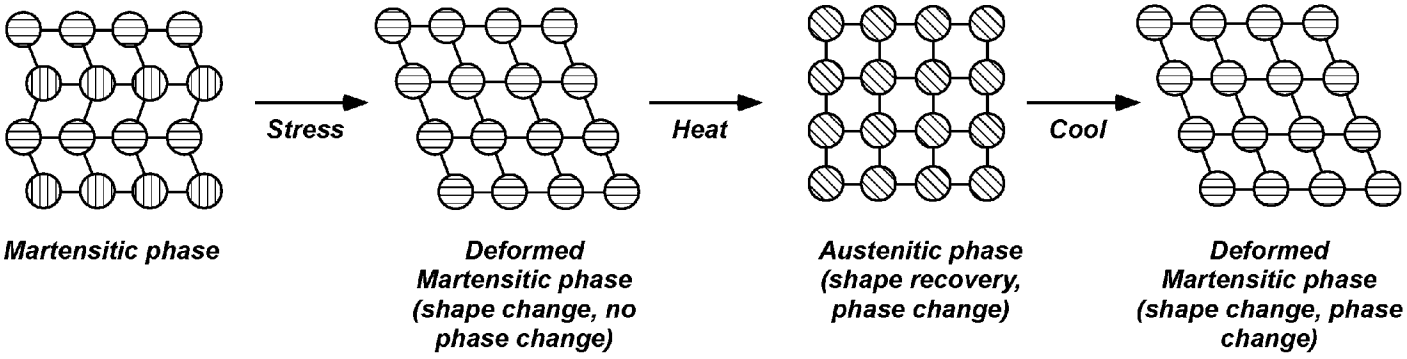

Other shape memory alloys possess two-way shape memory, such that the shape memory alloy exhibits this shape memory effect upon heating and cooling. Shape memory alloys possessing two-way shape memory effect may, therefore, include two remembered sizes and shapes: a martensitic (i.e., low-temperature) shape and an austenitic (i.e., high-temperature) shape. Such a two-way shape memory effect is achieved by "training." By way of example and not limitation, the remembered austenitic and martensitic shapes may be created by inducing non-homogeneous plastic strain in a martensitic or austenitic phase, by aging under an applied stress, or by thermomechanical cycling. With reference to FIG. 3B, when a two-way shape memory alloy is cooled from an austenitic to a martensitic phase, some martensite configurations might be favored, so that the material may tend to adopt a preferred shape. By way of further non-limiting example, and without being bound by any particular theory, the applied stress may create permanent defects, such that the deformed crystal structure of the martensitic phase is remembered. After the applied stress is removed, the material retains the deformed size and/or shape. Upon heating, martensite may transform and revert to austenite between the first temperature ($A_s$) and the second, higher temperature ($A_f$). Upon a complete transition to austenite, the material returns to its original remembered size and shape. The heating and cooling procedures may be repeated such that the material transforms repeatedly between the remembered martensitic and the remembered austenitic shapes.

A shape memory polymer may exhibit a similar shape memory effect. Heating and cooling procedures may be used to transition a shape memory polymer between a hard phase and a soft phase by heating the polymer above, for example, a melting point or a glass transition temperature ($T_g$) of the shape memory polymer and cooling the polymer below the melting point or glass transition temperature ($T_g$) as taught in, for example, U.S. Pat. No. 6,388,043, issued May 14, 2002, and titled "Shape Memory Polymers," the entire disclosure of which is incorporated herein by this reference. The shape memory effect may be triggered by a stimulus which may be thermal, electrical, magnetic, or chemical. As known in the art, polymers may have different properties than alloys, and thus, an actuator 102 including a shape memory polymer may have different properties or dimensions than an actuator 102 including a shape memory alloy. For example, an actuator 102 including a polymer may be relatively larger than a comparable actuator 102 that includes an alloy, if similar forces on the actuators 102 are expected.

Though discussed herein as having one or two remembered shapes, shape memory materials may have any number of phases, and may be trained to have a selected remembered shape in any or all of the phases.

The actuator 102 as shown in FIG. 2A may be a shape memory alloy in a martensitic phase, whereas the actuator 102 as shown in FIG. 2B may be the same shape memory alloy, but in an austenitic phase, or vice versa. The difference between the length $L_{102}'$ and the length $L_{102}$ of the actuator 102 may correspond to a change in the position of the bearing element 22 adjacent the surface of the blade 12. The depth-of-cut limiter 100 may be mounted within the drill bit 10 (FIG. 1) such that the bearing element 22 protrudes from an outer surface of the drill bit 10. For example, and end of the actuator 102 opposite the bearing element 22 may be mechanically coupled to the bit body 11 (e.g., within the blade 12), such that when the actuator 102 changes shape, the bearing element 22 moves. The position of the bearing element 22 may control the depth-of-cut of one or more of the cutting elements 14 by controlling the amount of the cutting surfaces of the cutting elements 14 exposed to the subterranean formation. In some embodiments, the difference between the length $L_{102}'$ and the length $L_{102}$ of the actuator 102 may be from about 0.01 in (0.254 mm) to about 2.0 in (50.8 mm), such as from about 0.02 in (0.508 mm) to about 1.0 in (25.4 mm), from about 0.05 in (1.27 mm) to about 0.50 in (12.7 mm), or from about 0.10 in (2.54 mm) to about 0.30 in (7.62 mm). The difference between the length $L_{102}'$ and the length $L_{102}$ of the actuator 102 may be selected based on cutting element properties, expected formation properties, drilling speed, or any other relevant factor.

Tools as described herein may be used to form or service (e.g., enlarge) a wellbore by changing the exposure of one or more cutting elements (e.g., primary cutting elements or backup cutting elements) on a tool while rotating the tool within the wellbore. For example, when the drill bit 10 (FIG. 1) is rotated within a wellbore, a stimulus may be applied to the actuator 102 (FIG. 2A) to convert the shape memory material of the actuator 102 from a first shape (FIG. 2A) to a second shape (FIG. 2B). The drill bit 10 may continue rotating during and after the transformation. The cutting elements 14 (FIG. 1) on the drill bit 10 may have a different exposure to the formation material after the transformation. The stimulus may include heating the actuator 102, cooling the actuator 102, applying a voltage to the actuator 102, or any other appropriate stimulus. The stimulus may convert the actuator 102 from one solid phase to another. For example, if the actuator 102 includes a shape memory alloy, the shape memory alloy may be converted from a martensitic phase to an austenitic phase or vice versa.

Figure 4A:
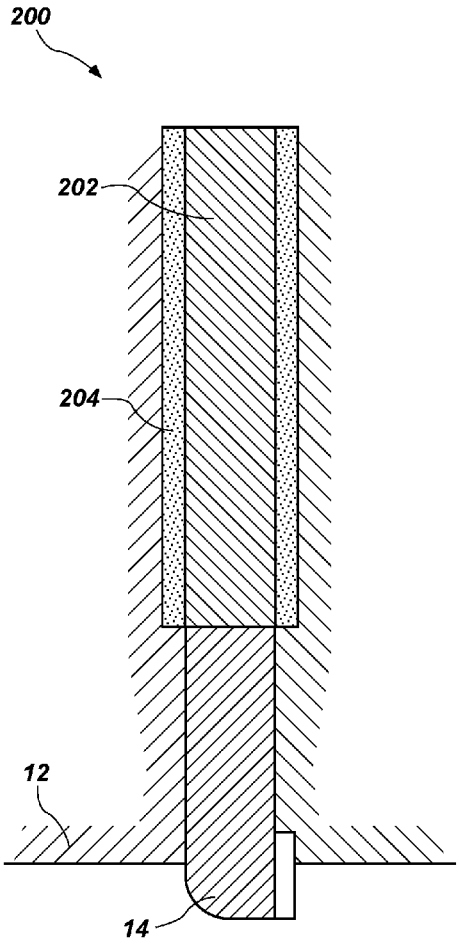
FIGS. 4A and 4B are simplified cross-sectional views of an actuator coupled to a cutting element.
Figure 4B:
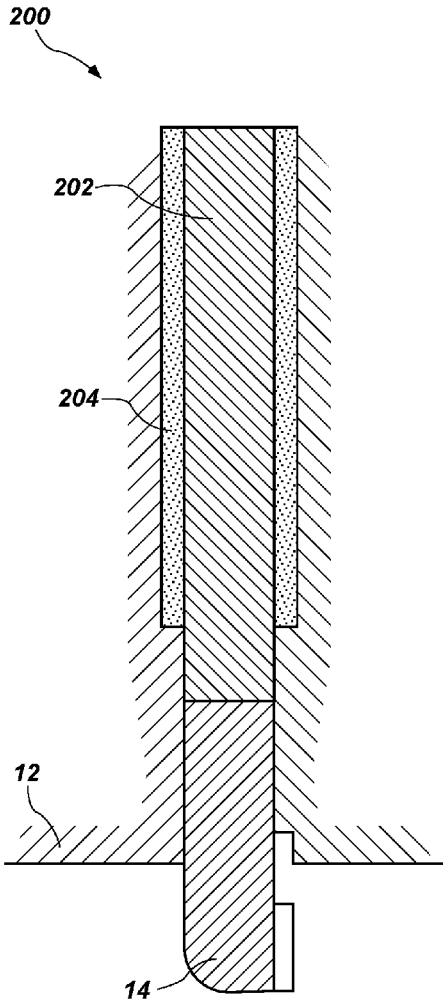

In some embodiments, an actuator may be used to adjust the position of a cutting element 14, rather than the position of a bearing element 22. For example, and as shown in FIGS. 4A and 4B, a cutting structure 200 may include an actuator 202 mechanically coupled to a cutting element 14 within the blade 12 of a bit body 11 (FIG. 1). A phase change of the actuator 202 may cause movement of the cutting element 14 with respect to a surface of bit body 11, and may therefore change the exposure of that cutting element 14. In some embodiments, the actuator 202 may change the orientation of the cutting element 14, such as to change a back rake angle of the cutting element 14 with respect to a formation. The cutting element 14 may be, for example, a primary cutting element or a backup cutting element. If the cutting element 14 to be moved by the actuator 202 is a backup cutting element, the actuator 202 may engage or disengage the backup cutting element. A temperature modification element 204 may be configured to heat and/or cool the actuator 202 to effect transformation from the first phase to the second phase. In other embodiments, actuators may be used to control the position of any portion a drill bit 10 or other tool used to form or service a wellbore, such as roller cone bits, percussion bits, hybrid bits, reamers, etc.

Figure 5:
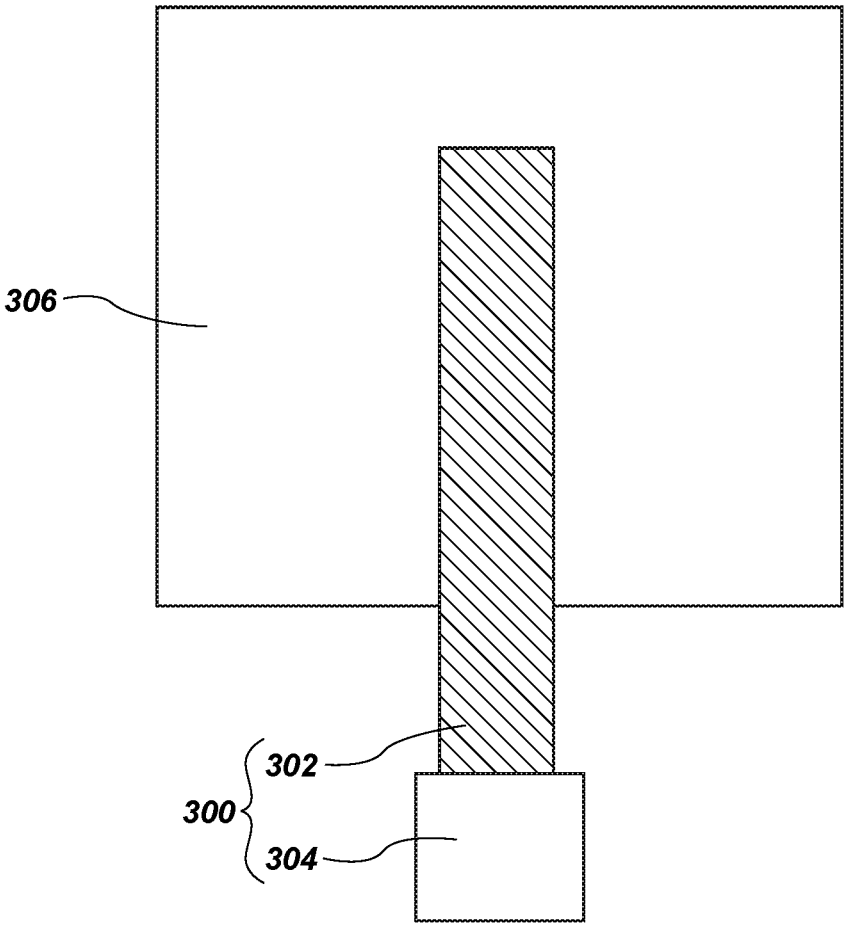
FIG. 5 is a simplified cross-sectional view of an actuator coupled to any selected bodies generically represented by rectangular boxes.

As shown in FIG. 5, an assembly 300 may include an actuator 302 and any other body 304. The actuator 302 may be used to adjust the position of the other body 304 with respect to a third body 306. The other body 304 may be any body known in the art of drilling, and is generically represented by a rectangular box. For example, in some embodiments, an actuator 302 may be used in a hybrid bit to change the degree of engagement of legs (with cones), such as to engage or disengage the bit with interbedded formations. Similarly, on a fixed-cutter bit, an actuator 302 may be used to change the relative spacing or to engage and disengage blades. Actuators 302 may engage and disengage a sensor on a bit body, such as to push the sensor against formation during measurement and then disengage it to avoid potential damage. In other embodiments, an actuator 302 may be used to actively control the size of a nozzle orifice to control fluid flow (e.g., by rotating a valve).

Figure 6:
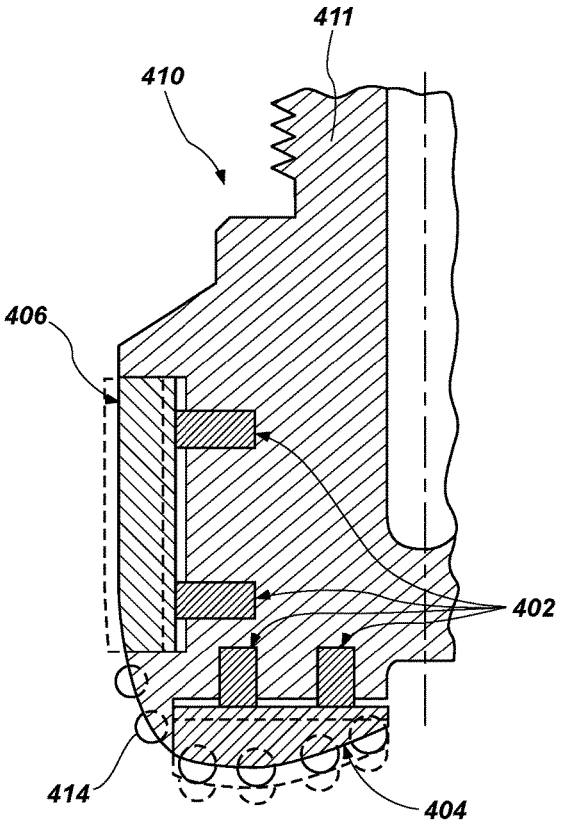
FIGS. 6 through 9 are simplified cross-sectional views of drill bits having actuators configured to adjust properties of the drill bits.

FIG. 6 is a simplified cross-sectional view of a portion of a drill bit 410 having actuators 402 that include a shape memory material. The actuators 402 may control the position of a blade face pad 404 or a gage pad 406 relative to a bit body 411, such as between the positions shown and the positions indicated by dashed lines. The blade face pad 404, the gage pad 406, and/or the bit body 411 may have cutting elements 414 attached thereto. Thus, a change of the shape of the actuators 402 may adjust the position of the cutting elements 414 relative to one another or other properties of the drill bit 410.

Figure 7:
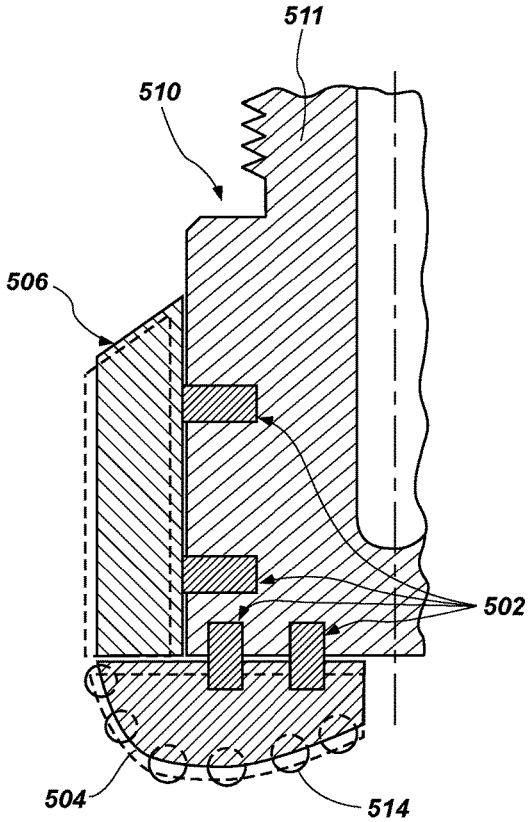

FIG. 7 is a simplified cross-sectional view of a portion of another drill bit 510 having actuators 502 that include a shape memory material. The actuators 502 may control the position of a blade face 504 or a gage 506 relative to a bit body 511, such as between the positions shown and the positions indicated by dashed lines. The blade face 504 and/or the gage 506 may have cutting elements 514 attached thereto. Thus, a change of the shape of the actuators 502 may adjust the position of the cutting elements 514 relative to one another or other properties of the drill bit 510.

Figure 8:
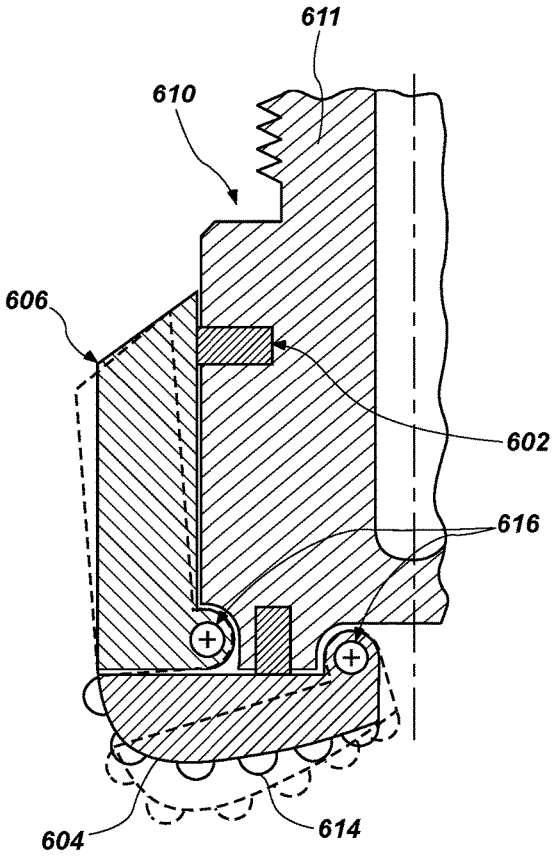

FIG. 8 is a simplified cross-sectional view of a portion of another drill bit 610 having actuators 602 that include a shape memory material. The actuators 602 may control the position of a blade face 604 or a gage 606 relative to a bit body 611, such as between the positions shown and the positions indicated by dashed lines. The blade face 604 or the gage 606 may be connected to the bit body 611 by a pivot connection 616, such that a change in shape of the actuators 602 causes the blade face 604 or the gage 606 to rotate about an axis through the pivot connection 616. The blade face 604 and/or the gage 606 may have cutting elements 614 attached thereto. Thus, a change of the shape of the actuators 602 may adjust the position of the cutting elements 614 relative to one another or other properties of the drill bit 610.

Figure 9:
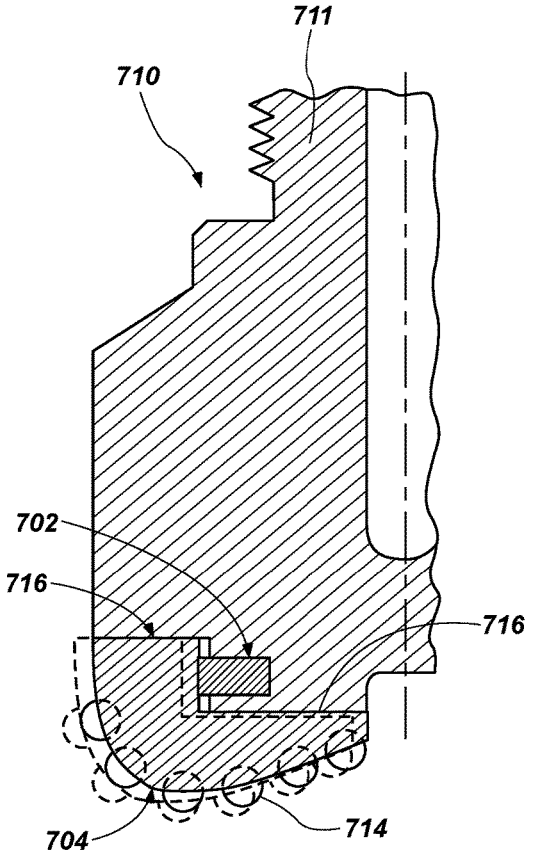

FIG. 9 is a simplified cross-sectional view of a portion of another drill bit 710 having an actuator 702 that includes a shape memory material. The actuator 702 may control the position of a blade face 704 relative to a bit body 711, such as between the positions shown and the positions indicated by dashed lines. Surfaces 716 of the blade face 704 may slide along corresponding surfaces of the bit body 711. In some embodiments, the surfaces 716 may be shaped to allow movement of the blade face 704 only in two opposing directions. For example, the surfaces 716 may be shaped as a tongue-and-groove sliding joint. The blade face 704 may have cutting elements 714 attached thereto. Thus, a change of the shape of the actuators 702 may adjust the position of the cutting elements 714 to change properties of the drill bit 710.

Shape memory materials may be beneficial in depth-of-cut limiters as described herein because they may be relatively simpler than conventional adjustable depth-of-cut limiters (which typically require springs, ratcheting parts, etc.). Thus, depth-of-cut limiters using shape memory materials may be cheaper and easier to manufacture or maintain, or may be relatively smaller than conventional devices, such that the depth-of-cut limiters may be placed in bits or portions thereof too small for conventional devices. Thus, such depth-of-cut limiters may be practical in a wider range of applications than conventional devices.

Changing the depth-of-cut of a cutting element or other cutting structure may have benefits for certain drilling operations. For example, when a drill bit moves from a hard formation to a soft formation, a different cutting profile may be selected to limit balling. When a drill bit moves from a soft formation to a hard formation, changing the profile may limit damage to the bit. Without the ability to easily adjust the depth-of-cut, a drilling operator may choose to return the drill bit to the surface and exchange for a different bit. Alternatively, when drilling through relatively thin formations, a drilling operator may simply accept that the drill bit in the borehole is not well-suited for that application, but that the costs of changing the bit (with the associated downtime) are too high. By selecting a bit that uses shape memory materials to adjust the depth-of-cut of cutting elements, such costs of changing bits or accepting poor cutting ability for a portion of the run may be avoided.

Although the present disclosure has been described in terms of a fixed-cutter bit, similar materials and structures may be used with other types of bits, as well as other tools, such as reamers, mills, etc. Thus, embodiments of the disclosure may also apply to such tools, and to systems and devices including such tools.

Additional non-limiting example embodiments of the disclosure are described below.

Embodiment 1

An earth-boring tool comprising a bit body and an actuator coupled to the bit body and comprising at least one shape memory material configured to transform from a first shape to a second shape to change a position of at least one of a bearing pad or a cutting element coupled to the actuator with respect to the bit body in response to a stimulus. A transformation from the first shape to the second shape comprises a phase change in the at least one shape memory material from a first solid phase to a second solid phase.

Embodiment 2

The earth-boring tool of Embodiment 1, wherein the at least one shape memory material is configured to transform from the first shape to the second shape when heated above a preselected temperature.

Embodiment 3

The earth-boring tool of Embodiment 1 or Embodiment 2, wherein the at least one shape memory material is configured to transform from the second shape to the first shape when cooled below a preselected temperature.

Embodiment 4

The earth-boring tool of any of Embodiments 1 through 3, wherein the at least one shape memory material is configured to transform from the first shape to the second shape when subjected to at least one of an electrical stimulus, a chemical stimulus, or a magnetic stimulus.

Embodiment 5

The earth-boring tool of any of Embodiments 1 through 4, wherein the at least one shape memory material comprises an alloy selected from the group consisting of Ni-based alloys, Cu-based alloys, Co-based alloys, Fe-based alloys, Ti-based alloy, Al-based alloys, and mixture thereof.

Embodiment 6

The earth-boring tool of any of Embodiments 1 through 4, wherein the at least one shape memory material comprises a polymer.

Embodiment 7

The earth-boring tool of any of Embodiments 1 through 6, wherein the actuator is configured to change an exposure of a cutting element coupled to the actuator in response to the stimulus.

Embodiment 8

The earth-boring tool of any of Embodiments 1 through 7, further comprising a temperature modification element thermally coupled to the actuator. The temperature modification element is disposed adjacent the actuator and configured to adjust a temperature of the actuator.

Embodiment 9

A depth-of-cut limiter for an earth-boring tool comprising a bearing element and at least one shape memory material mechanically coupled to the bearing element. The bearing element is configured to contact an exposed surface of a subterranean formation when the depth-of-cut limiter is used in an earth-boring tool to form or service a wellbore. The at least one shape memory material is configured to transform from a first shape to a second shape in response to a stimulus. A transformation from the first shape to the second shape comprises a phase change in the at least one shape memory material from a first solid phase to a second solid phase.

Embodiment 10

The depth-of-cut limiter of Embodiment 9, wherein the bearing element has an ovoid exterior surface.

Embodiment 11

The depth-of-cut limiter of Embodiment 9 or Embodiment 10, wherein the at least one shape memory material comprises a generally cylindrical rod.

Embodiment 12

The depth-of-cut limiter of any of Embodiments 9 through 11, wherein the at least one shape memory material is configured to transform from the first shape to the second shape when heated above a preselected temperature.

Embodiment 13

The depth-of-cut limiter of any of Embodiments 9 through 12, wherein the at least one shape memory material is configured to transform from the second shape to the first shape when cooled below a preselected temperature.

Embodiment 14

The depth-of-cut limiter of any of Embodiments 9 through 13, wherein the at least one shape memory material is configured to transform from the first shape to the second shape when subjected to at least one of an electrical stimulus, a chemical stimulus, or a magnetic stimulus.

Embodiment 15

The depth-of-cut limiter of any of Embodiments 9 through 14, wherein the at least one shape memory material comprises an alloy selected from the group consisting of Ni-based alloys, Cu-based alloys, Co-based alloys, Fe-based alloys, Ti-based alloy, Al-based alloys, and mixture thereof.

Embodiment 16

The depth-of-cut limiter of any of Embodiments 9 through 14, wherein the at least one shape memory material comprises a polymer.

Embodiment 17

The depth-of-cut limiter of any of Embodiments 9 through 16, further comprising a temperature modification element thermally coupled to the at least one shape memory material. The temperature modification element is disposed adjacent the actuator and configured to adjust a temperature of the actuator.

Embodiment 18

A method of forming or servicing a wellbore, comprising rotating an earth-boring tool within a wellbore. The earth-boring tool comprises a bit body and an actuator coupled to the bit body. The actuator comprises at least one shape memory material configured to transform from a first shape to a second shape to change a position of at least one of a bearing pad or a cutting element with respect to the bit body in response to a stimulus. A transformation from the first shape to a second shape comprises a phase change in the at least one shape memory material from a first solid phase to a second solid phase. The method further comprises applying a stimulus to the actuator to convert the at least one shape memory material from the first shape to the second shape, and continuing to rotate the earth-boring tool within the wellbore after applying the stimulus.

Embodiment 19

The method of Embodiment 18, wherein applying a stimulus to the actuator comprises heating the at least one shape memory material above a preselected temperature.

Embodiment 20

The method of Embodiment 18 or Embodiment 19, wherein the at least one shape memory material comprises at least one alloy, and wherein applying a stimulus to the actuator comprises converting the at least one alloy from a martensitic phase to an austenitic phase.

While the present disclosure may be susceptible to various modifications and alternative forms, specific embodiments have been shown by way of example in the drawings and have been described in detail herein. However, it should be understood that the disclosure is not limited to the particular font's disclosed. Rather, the disclosure includes all modifications, equivalents, legal equivalents, and alternatives falling within the scope of the disclosure as defined by the appended claims. Further, embodiments of the disclosure have utility with different and various tool types and configurations.

What is claimed is:

1. An earth-boring tool, comprising:

a body;

an actuator mechanically coupled to the body and comprising at least one shape memory material configured to transform from a first shape to a second shape;

the actuator further mechanically coupled to at least one of a blade or a gage pad to change a position of at least one of a bearing pad, a cutting element, a blade, a nozzle member, or a sensor with respect to the body in response to a stimulus, wherein a transformation from the first shape to the second shape comprises a phase change in the at least one shape memory material from a first solid phase to a second solid phase; and a resistive heating element or thermoelectric heater thermally coupled to the actuator to provide the stimulus, the resistive heating element or thermoelectric heater comprising a sleeve surrounding the actuator and configured to adjust a temperature of the actuator.

2. The earth-boring tool of claim 1, wherein the at least one shape memory material is configured to transform from the first shape to the second shape when the stimulus comprising an electrical stimulus.

3. The earth-boring tool of claim 1, wherein the at least one shape memory material comprises an alloy selected from the group consisting of Ni-based alloys, Cu-based alloys, Co-based alloys, Fe-based alloys, Ti-based alloy, Al-based alloys, and mixture thereof.

4. The earth-boring tool of claim 1, wherein the at least one shape memory material comprises a polymer.

5. The earth-boring tool of claim 1, wherein the actuator is configured to change an exposure of a cutting element coupled to the actuator in response to the stimulus.

6. The earth-boring tool of claim 1, wherein the at least one blade or gage pad is mechanically coupled to the body by a pivot connection such that a change in shape of the actuator changes a position of the at least one blade or gage pad relative to the body and causes the at least one blade or gage pad to rotate about an axis through the pivot connection.

7. The earth-boring tool of claim 1, wherein surfaces of the at least one blade or gage pad are shaped to allow movement of the at least one blade or gage pad only in two directions such that a change in shape of the actuator changes a position of the at least one blade or gage pad relative to the body and causes the at least one blade or gage pad to slide along corresponding surfaces of the body.

8. A depth-of-cut limiter for an earth-boring tool, comprising:

a bearing element configured to contact an exposed surface of a subterranean formation when the depth-of-cut limiter is used in an earth-boring tool to form or service a wellbore;

at least one shape memory material mechanically coupled to the bearing element, the at least one shape memory material configured to transform from a first shape to a second shape in response to a stimulus, wherein a transformation from the first shape to the second shape comprises a phase change in the at least one shape memory material from a first solid phase to a second solid phase;

the at least one shape memory material further mechanically coupled to a body of an earth boring tool; and a resistive heating element or thermoelectric heater thermally coupled to the at least one shape memory material to provide the stimulus, the resistive heating element or thermoelectric heater comprising a sleeve surrounding the at least one shape memory material and configured to adjust a temperature of the at least one shape memory material.

9. The depth-of-cut limiter of claim 8, wherein the bearing element has an ovoid exterior surface.

10. The depth-of-cut limiter of claim 8, wherein the at least one shape memory material comprises a generally cylindrical rod.

11. The depth-of-cut limiter of claim 8, wherein the at least one shape memory material is configured to transform from the first shape to the second shape when heated above a preselected temperature.

12. The depth-of-cut limiter of claim 8, wherein the at least one shape memory material is configured to transform from the second shape to the first shape when cooled below a preselected temperature.

13. The depth-of-cut limiter of claim 8, wherein the at least one shape memory material is configured to transform from the first shape to the second shape when the stimulus comprising an electrical stimulus.

14. The depth-of-cut limiter of claim 8, wherein the at least one shape memory material comprises an alloy selected from the group consisting of Ni-based alloys, Cu-based alloys, Co-based alloys, Fe-based alloys, Ti-based alloy, Al-based alloys, and mixture thereof.

15. The depth-of-cut limiter of claim 8, wherein the at least one shape memory material comprises a polymer.

16. A method of forming or servicing a wellbore, comprising:

rotating an earth-boring tool within a wellbore, the earth-boring tool comprising:

a body; and an actuator mechanically coupled to the body and comprising at least one shape memory material configured to transform from a first shape to a second shape;

the actuator further mechanically coupled to at least one of a blade or a gage pad to change a position of at least one of a bearing pad, a cutting element, a blade, a nozzle member, or a sensor with respect to the body in response to a stimulus, wherein a transformation from the first shape to the second shape comprises a phase change in the at least one shape memory material from a first solid phase to a second solid phase;

applying a stimulus to the actuator to convert the at least one shape memory material from the first shape to the second shape utilizing a resistive heating element or thermoelectric heater thermally coupled to the actuator, the resistive heating element or thermoelectric heater comprising a sleeve surrounding the actuator and configured to adjust a temperature of the actuator; and continuing to rotate the earth-boring tool within the wellbore after applying the stimulus.

17. The method of claim 16, wherein applying a stimulus to the actuator comprises heating the at least one shape memory material above a preselected temperature.

18. The method of claim 16, wherein the at least one shape memory material comprises at least one alloy, and wherein applying a stimulus to the actuator comprises converting the at least one alloy from a martensitic phase to an austenitic phase.

* * * * *